United States Patent [19]

Iizuka

[11] Patent Number: 4,867,708

[45] Date of Patent: Sep. 19, 1989

[54] ELECTRIC JACK

[75] Inventor: Akichika Iizuka, Tomioka, Japan

[73] Assignee: Iizuka Electric Industry Company Limited, Japan

[21] Appl. No.: 136,340

[22] Filed: Dec. 22, 1987

[30] Foreign Application Priority Data

Dec. 27, 1986 [JP] Japan ..... 61-203298[U]
Dec. 27, 1986 [JP] Japan ..... 61-203299[U]
Jan. 20, 1987 [JP] Japan ..... 62-6859[U]

[51] Int. Cl.[4] ..... H01R 17/18

[52] U.S. Cl. ..... 439/668; 439/669; 439/744

[58] Field of Search ..... 439/668–670, 439/744

[56] References Cited

U.S. PATENT DOCUMENTS

| | | | |
|---|---|---|---|
| 4,165,147 | 8/1979 | Buck | 439/668 |
| 4,364,625 | 12/1982 | Baker et al. | 439/669 |
| 4,367,907 | 1/1983 | Buck | 439/669 |
| 4,598,970 | 7/1986 | Takihara | 439/668 |
| 4,673,239 | 6/1987 | Smith et al. | 439/744 |
| 4,710,139 | 12/1987 | Shichida | 439/668 |

*Primary Examiner*—William L. Sikes
*Assistant Examiner*—B. R. R. Holloway
*Attorney, Agent, or Firm*—Peter J. Georges

[57] ABSTRACT

An electric jack for receiving a plug to form the electric connection therebetween includes a main body made of electrically insulated resin and a plurality of movable contact strips. The main body has formed therein; a central hole through which the plug is insertable in an axial direction; a plurality of contact strip-clamping recesses extending in a direction perpendicular to the axial direction, the recesses being arranged in parallel with each other in the axial direction; a plurality of contact strip-fitting holes each being communicated with respective recesses; and a window portion through which the recesses are communicated with the central hole. The movable contact strip has a fitting portion to be inserted into the fitting hole of the main body and a contact portion to be clamped into the recess of main body. When the movable contact strip is inserted into the main body, the contact portion of movable contact strip is partially projected into the central hole through the window portion.

8 Claims, 6 Drawing Sheets

ELECTRIC JACK

This application is related to U.S. application Ser. No. 940,071, filed Dec. 10, 1986, entitled ELECTRIC JACK.

BACKGROUND OF THE INVENTION

1. Field of the Invention

The present invention relates to an electric jack for receiving an electric plug to establish an electrical connection therebetween. Such an electric jack is widely used in various electronic apparatuses such as audio devices and video devices.

2. Description of the Related Art

There have been developed various kinds of electric jacks for use in audio and video devices. These electric jacks have different shapes and are constructed from different numbers of components in accordance with particular applications. Nowadays, the number of contacts provided in an electric jack has become larger and larger and the construction has become very complicated, so that the manufacturing process has become difficult and the electrical property of the jack might be diminished. For instance, different kinds of contacts must be prepared for a chip, a ring and a sleeve of a plug in order to meet the variety of commerecial needs and thus, the known electric jack has a serious drawback from the view point of economy.

SUMMARY OF THE INVENTION

The present invention has for its object to provide a novel and useful electric jack which can be constructed with a smaller number of parts and also has a simple construction, so that it can be manufactured in an easy and economical manner.

It is another object of the invention to provide an electric jack which comprises contact members of the same construction for forming the electric connection for various portions of a plug having different diameters.

According to the invention, an electric jack comprises:

a main body made of electrically insulating material and having a central hole extending in a first direction into which a plug is inserted a plurality of contact strip-clamping recesses extending in a second direction perpendicular to the first direction, a window portion through which the contact strip-clamping portions are communicated with the central hole, and a plurality of contact strip-fitting holes, each communicated with respective contact strip-clamping recesses; and a plurality of contact strips each being made of a metal plate and having a fitting portion which is inserted into the contact strip-fitting hole of the main body and a contact portion which is clamped in the contact strip-clamping recess of the main body, a part of the contact portion being projected into the central hole through the window portion.

DESCRIPTION OF THE PREFERRED EMBODIMENTS

Figure 1A:
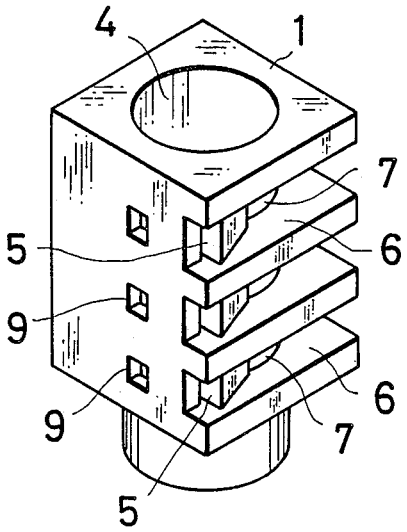
FIG. 1 (*a*a), (*b*) and (*c*) are perspective views showing a main body and a contact strip of an embodiment of the electric jack according to the invention.
Figure 1B:
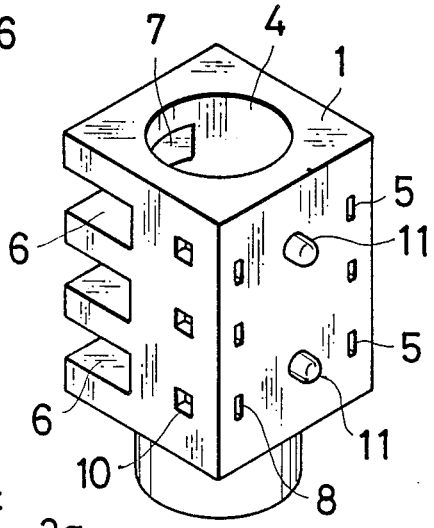
Figure 1C:
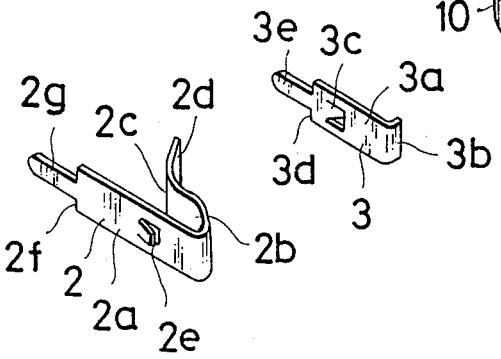

FIGS. 1(*a*) and 1(*b*) are perspective views showing a main body 1 of a first embodiment of the electric jack according to the invention. FIG. 1(*c*) is a perspective view illustrating movable and stationary contact strips 2 and 3 to be installed in the main body 1.

The main body 1 is made of electrically insulating material such as plastic and has a central hole 4 into which a plug is insertable. The central hole 4 extends in a longitudinal direction. In a side surface of the main body 1 there are formed a plurality of movable contact strip-fitting holes 5 and a plurality of contact strip-clamping recesses 6, each being communicated with respective holes 5. The recesses 6 extend in a lateral direction perpendicular to the longitudinal direction. The contact strip-clamping recesses 6 are communicated with the central hole 4 by a window portion 7. Further, the bottom surfaces of recesses 6 is inclined toward the window portion 7. In the main body 1, there are further provided a plurality of stationary contact strip-fitting holes 8, each communicated with respective recesses 6. In the movable and stationary contact strip-fitting holes 5 and 8 there are formed small retaining holes 9 and 10, respectively which serve to retain these contact strips 2 and 3 in the main body 1. In a rear side of the main body 1, there are further provided projections 11 for positioning the electric jack with respect to a printed circuit board (not shown).

As best shown on the left side of FIG. 1(*c*), the movable contact strip 2 is formed by a metal strip having a good electrical conduction, a mechanical resilience, and a fitting portion 2*a* which is inserted into the hole 5, a movable portion 2*b* which has a width only slightly narrower than the width of the recess so that the contact strip 2 is clamped into the recess 6, a contact portion 2*c*, a front contact portion 2*d*, a retaining lug 2*e* provided in the fitting portion 2*a*, a step portion 2*f* which is brought into contact with the rear wall of the main body 1, and a narrow front end portion 2*g* which projects beyond the hole 5.

As best shown on the right side of FIG. 1(*c*), the stationary contact strip 3 is also made of a metal strip and has a fitting portion 3*a* which is firmly inserted into the fitting hole 8, a contact portion 3*b* which is brought into contact with the contact portion 2*d* of the movable contact strip 2, a retaining lug 3*c* which is inserted in the small retaining hole 10 a step portion 3*d* which is brought into contact with the rear wall of the main body 1, and a narrow front end portion 3*e* which projects beyond the hole 8.

The fitting portion 2*a* of the movable contact strip 2 is inserted into the hole 5 of the main body 1 until the step portion 2*f* is brought into contact with the rear wall of the main body 1. In this inserted condition, the retaining lug 2*e* projects into the retaining hole 9 so that the contact strip 2 is prevented from being removed from the main body 1, and the contact portion 2*c* projects into the central hole 4 through the window portion 7. In a similar manner, the stationary contact strip 3 is inserted into the hole 8 of the main body 1 until the step portion 3*d* is urged against the rear wall of the main body 1 and the retaining lug 3*c* projects into the retaining hole 10. In the inserted condition, the front end contact portion 2*d* of the movable contact strip 2 is brought into contact with the contact portion 3*d* of the stationary contact strip 3.

Figure 2:
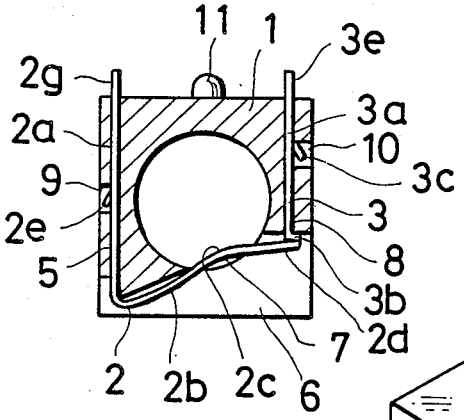
FIG. 2 is a cross-sectional view illustrating the electric jack shown in FIG. 1.

FIG. 2 shows the condition in which the plug is not inserted into the central hole 4 of the main body 1. In this condition, the front end contact portion 2*d* of the movable contact strip 2 is resiliently brought into contact with the contact portion 3*b* of the stationary contact strip 3. When the plug is inserted into the central hole 4, the plug contact portion 2*c* of the movable contact strip 2 is pushed by the inserted plug and is moved outwardly up to a position inside the central hole 4 so that the movable contact strip 2 is resiliently brought into contact with the plug. During the movement of the movable portion 2*b* of the movable contact strip 2 due to the insertion of the plug into the central hole 4 of the main body 1, the front end contact portion 2*d* of the movable contact strip 2 is separated from the contact portion 3*b* of the stationary contact strip 3 so that the electrical connection therebetween is opened.

Figure 3:
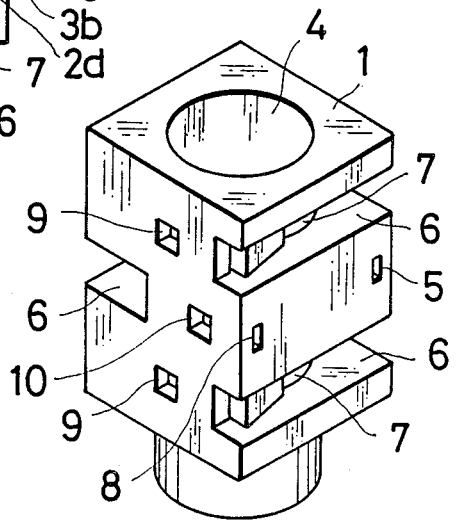
FIG. 3 is a perspective view illustrating another embodiment of the main body.

FIG. 3 is a perspective view showing a second embodiment of the main body 1. In this embodiment, odd and even-numbered contact strip-fitting recesses 6 are formed with widths only slightly larger than the widths of the contact strips 2 inserted in front and rear walls of the main body 1, respectively. In such a construction, a distance between the successive end portions 2*g* of the movable contact strips 2 viewed in the axial direction of FIG. 2 and a distance between the successive end portions 3*e* of the stationary contact strips 3 viewed in the axial direction also in FIG. 2 can be extended.

Figure 4:
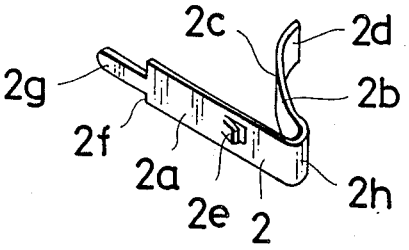
FIGS. 4, 5(*a*) and 5(*b*) are perspective and cross-sectional views showing three embodiments of the contact strip.
Figure 5:
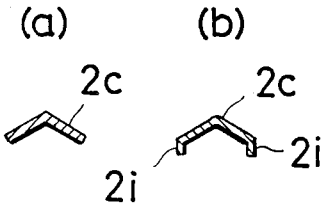

FIG. 4 is a perspective view illustrating another embodiment of the movable contact strip 2. In this embodiment, there is provided a cushion portion 2*b* which projects outwardly to a large extent so that the resiliency of the movable contact strip 2 is increased. FIGS. 5(*a*) and 5(*b*) are cross-sectional views showing the plug contact portion 2*c* of two other embodiments of the movable contact strip 2. In these embodiments, the plug contact portion 2*c* has a flat V-shaped cross-section and a V-shaped cross-section with folded side edges 2*i*, respectively, so that the plug can be smoothly inserted into and removed from the electric jack.

In the electric jack according to the invention, when the plug has different diameter portions viewed in the axial direction, the depths of the contact-fitting recesses 6 can be changed in accordance with the diameters, but the widths must remain only slightly larger than the widths of the strips 2 so that the movable contact strips 2 having the same configuration can be still used. In the embodiments so far explained, the stationary contact strips 3 are used, but they are not indispensable and may be deleted.

Figure 6A:
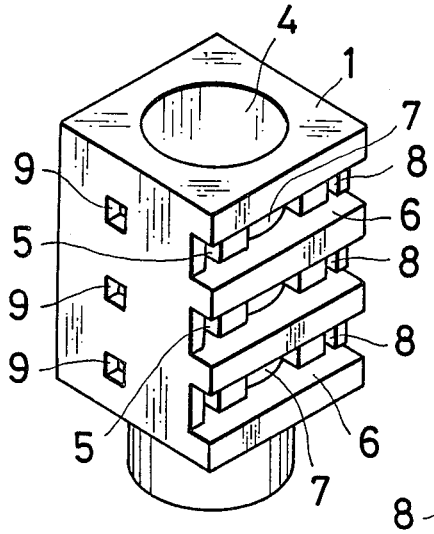
FIGS. 6(*a*) and 6(*b*) are perspective views depicting another embodiment of the main body.
Figure 6B:
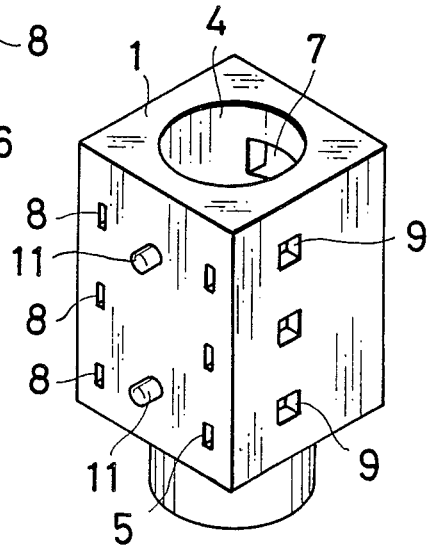
Figure 7:
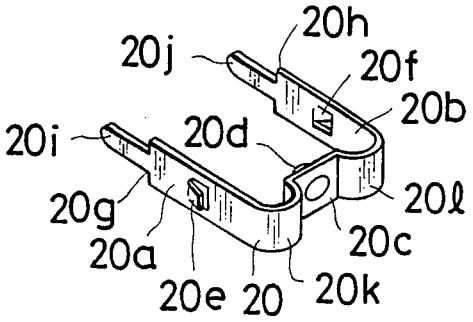
FIG. 7 is a perspective view showing another embodiment of the contact strip.

FIGS. 6 and 7 depict still another embodiment of the electric jack according to the invention in which only movable contact strips 20 are used. FIGS. 6(*a*) and 6(*b*) are perspective views showing the main body 1 and FIG. 7 is a perspective view illustrating the substantially U-shaped movable contact strip 20. The main body 1 is substantially similar to that of the previous embodiment except for the point that the fitting holes 5 and 8 are formed symmetrically with respect to the window portion 7.

The movable contact strip 20 is formed by punching a metal plate and comprises two fitting portions 20*a* and 20*b* to be inserted into the holes 5 and 8. A movable portion 20*c* is to be inserted into the clamping recess 6. The movable portion 20*c* includes a contact portion 20*d* which is projected into the central hole 4 through the window portion 7. The fitting portions 20*a* and 20*b* include retaining lugs 20e and 20f, step portions 20g and 20*h*, and narrow front end portions 20*i* and 20*j*, respectively. Between the fitting portions (20*a*, 20*b*) and the movable portion 20*c*, there are formed cushion portions 20*k* and 20l which project outwardly so that the resiliency of the contact portion 20*d* is enhanced.

Figure 8:
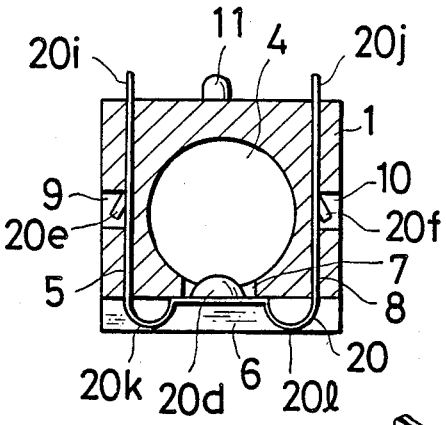
FIG. 8 is a cross-sectional view showing the electric jack composed of the main body and the contact strip shown in FIGS. 6 and 7.

FIG. 8 is a cross-sectional view showing a condition in which the contact strip 20 is inserted into the main body 1. In this condition, the fitting portions 20*a* and 20*b* are inserted into the holes 5 and 8 until the step portions 20*g* and 20*h* are brought into contact with the rear wall of the main body 1. The retaining lugs 20*e* and 20*f* are inserted in the holes 9 and 10 in the main body 1 so that the contact strip 20 can be effectively prevented from being removed from the main body 1. The front end portions 20*i* and 20*j* are the only portions of the contact strip 20 that are projected out of the main body 1 so that a substantial portion of each contact strip 20 is embedded in each recess 6 of the body 1. Electric wires (not shown) may be soldered to the front end portions 20*i* and 20*j*. Further, the contact portion 20*d* is partially projected into the central hole 4 via the window portion 7.

FIG. 8 also shows the condition in which the plug is not inserted into the central hole 4 of the main body 1. When the plug is inserted into the main body 1, the plug pushes the contact portion 20*d* of the movable contact strip 20 outwardly and thus, the plug is electrically connected to the contact strip 20 in a resilient manner.

Figure 9:
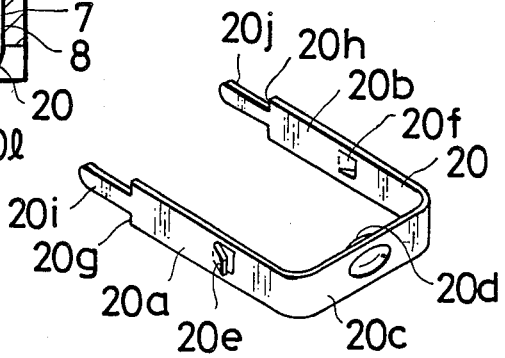
FIG. 9 is a perspective view illustrating still another embodiment of the contact strip.

FIG. 9 is a perspective view showing another embodiment of the movable contact strip 20. In the present embodiment, both ends of a contact portion 20*c* are directly connected to fitting portions 20*a* and 20*b* b without interposing the cushion portions 20*k* and 20l of FIG. 7. therebetween.

Figure 10:
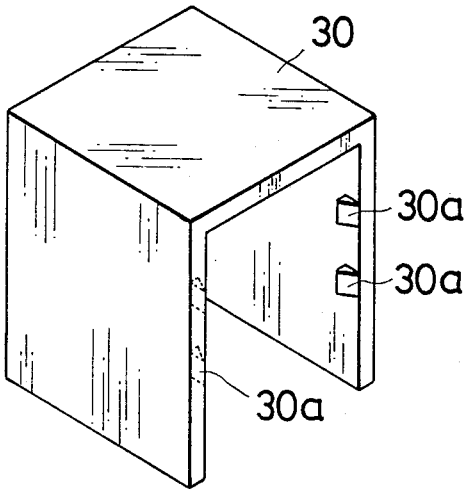
FIG. 10 is a perspective view showing the cap to cover on the main body.
Figure 11:
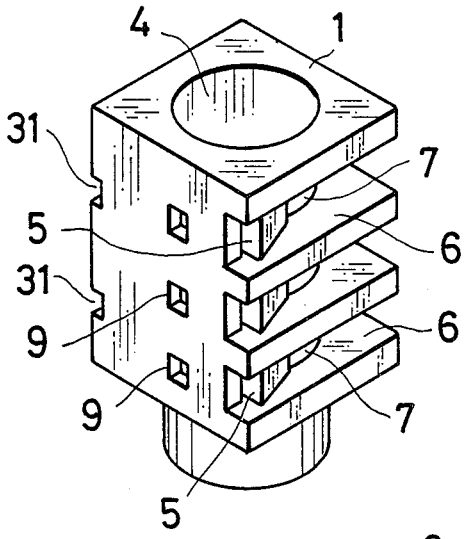
FIG. 11 is a perspective view depicting still another embodiment of the main body.

FIG. 10 is a perspective view illustrating a cap 30 to be fitted on the main body 1. The cap 30 is wholly made of electrically insulating resin and has triangular projections 30*a* formed on inner surfaces of side walls. The cap 30 is clamped on the main body 1 such that the rear wall and the central hole 4 of the main body 1 and exposed. As depicted in FIG. 11, at both sides of the rear wall of the main body 1, there are formed recesses 31 for retaining the projections 30*a* of the cap 30. After the movable contact strips (2, 20) and the stationary contact strips 3 have been inserted into the main body 1, the main body 1 is slipped into the cap 30 until the triangular retaining projections 30*a* are clamped into the recesses 31 of the main body 1.

Figure 12:
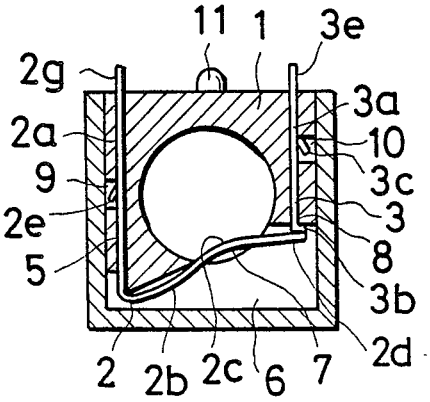
FIG. 12 is a cross-sectional view illustrating the electric jack having the cap fitted thereto.
Figure 13:
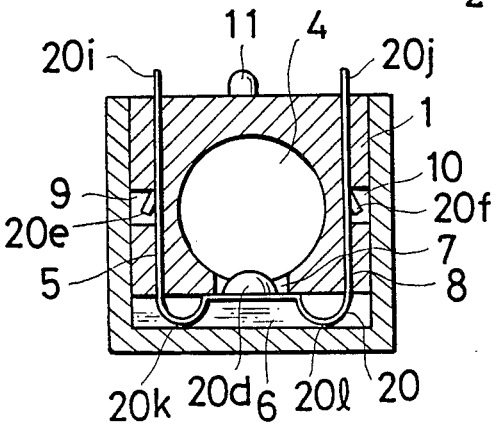
FIGS. 13 is a cross-sectional view representing the electric jack shown in FIG. 8 having the cap secured thereto.

FIG. 12 is a cross-sectional view showing a condition in which the main body 1 is covered with the cap 30. Since the contact-clamping recesses 6 are covered with the cap 30, dust is not introduced into the contact and the electrical property of the jack is improved. FIG. 13 is a cross-sectional view illustrating a condition in which the main body 1 shown in FIG. 6 is covered with the cap 30.

Figure 14:
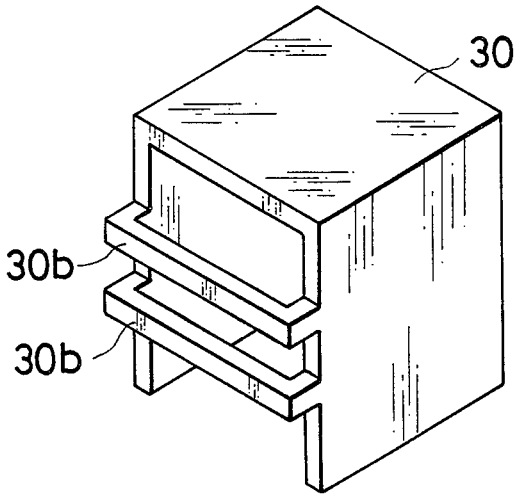
FIG. 14 is a perspective view showing another embodiment of the cap.
Figure 15:
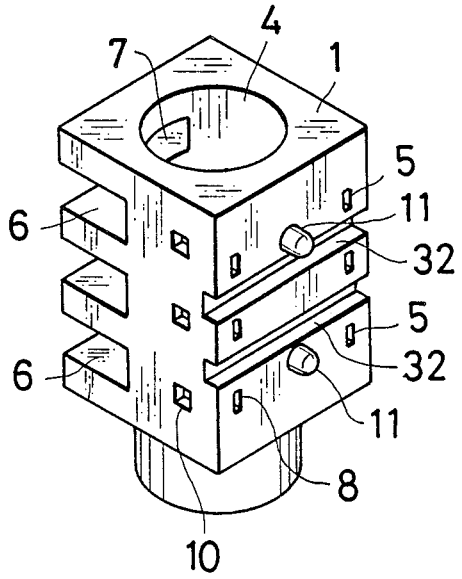
FIG. 15 is a perspective view illustrating still another embodiment of the main body to be used with the cap shown in FIG. 14.

FIG. 14 is a perspective view illustrating another embodiment of the cap 30 according to the invention. The cap 30 is made of soft synthetic resin and is fixed to the main body 1 shown in FIG. 15 with the aid of resilient locking bands 30*b* shown in FIG. 14, which bands 30*b* are fitted into locking recesses 32 formed in the rear wall of the main body 1 shown in FIG. 15.

As explained above, the electric jack according to the invention is formed by components which can be manufactured easily, and can be managed simply, assembled easily only by inserting the contact strips 2, 3 or 20 into the main body 1. Further, the number of contact strips 2, 3 and 20 can be easily increased or decreased in accordance with specific applications, so that the electric jack can comply with a variety of requirements. Moreover, the electric jack according to the invention can be made small in size and inexpensive in cost.

What is claimed is:

1. An electric jack for receiving a plug to form an electric connection therebetween comprising:

a main body made of electrically insulating material and having a central hole extending in a first direction, said plug being insertable into the central hole, a plurality of contact strip-clamping recesses extending in a second direction perpendicular to said first direction, a window portion through which contact strip-receiving portions are communicated with said central hole, and a plurality of contact strip-fitting holes each communicated with respective contact strip-clamping recesses; and a plurality of contact strips each being made of a metal plate and having: a fitting portion which is inserted into said contact strip-fitting hole of the main body; a contact portion which has a width only slightly narrower than the width of the recess so that each contact strip is clamped in said contact strip-clamping recess of the main body, a part of the contact portion being projected into said central hole through said window portion; and at least one end portion being the only portion of the contact strip exposed out of the main body so that a remaining substantial portion of the contact strip is embedded in the recess.

2. An electric jack according to claim 1, wherein said contact strip further comprises a retaining lug formed in the fitting portion, and said main body further comprises a plurality of retaining holes each communicated with respective retaining lugs, whereby each retaining lug is inserted into the respective retaining hole such that the contact strip is prevented from being removed from the main body.

3. An electric jack according to claim 1, wherein said contact strip further comprises a narrow end portion formed at a free end of the fitting portion, said end portion being projected out of the main body.

4. An electric jack according to claim 1, wherein movable and stationary contact strips are inserted into the main body such that free ends of contact portions of the contact strips are resiliently brought into contact with each other, said free ends being separated from each other when the plug is inserted into the central hole and the contact portions of the movable contact strip are pushed by the plug.

5. An electric jack according to claim 1, wherein said contact strip has a substantially U-shaped configuration including a contact portion and two fitting portions each connected to respective sides of the contact portion.

6. An electric jack according to claim 1, further comprising a cap which covers at least said contact strip-clamping recesses.

7. An electric jack according to claim 6, wherein said cap has retaining projections formed in inner surfaces of side walls, and said main body includes retaining recesses which are engaged with said retaining projections of said cap.

8. An electric jack according to claim 6, wherein said cap comprises at least one locking band made of resilient material, and said main body has at least one locking recess into which said locking band of the cap is clamped.

* * * * *